US009775779B2

(12) United States Patent
Ali

(10) Patent No.: US 9,775,779 B2
(45) Date of Patent: Oct. 3, 2017

(54) PRESCRIPTION BOTTLE CAP ASSEMBLY AND MEDICATION MANAGEMENT SYSTEM

(71) Applicant: Ahmed Ali, Clifton, NJ (US)

(72) Inventor: Ahmed Ali, Clifton, NJ (US)

(73) Assignee: CARECAPS, LLC, Clifton, NJ (US)

( * ) Notice: Subject to any disclaimer, the term of this patent is extended or adjusted under 35 U.S.C. 154(b) by 199 days.

(21) Appl. No.: 14/696,696

(22) Filed: Apr. 27, 2015

(65) Prior Publication Data

US 2015/0305984 A1 Oct. 29, 2015

Related U.S. Application Data

(60) Provisional application No. 61/985,043, filed on Apr. 28, 2014.

(51) Int. Cl.
*A61J 7/04* (2006.01)
*A61J 1/14* (2006.01)

(52) U.S. Cl.
CPC ..... *A61J 7/04* (2013.01); *A61J 1/1412* (2013.01); *A61J 2205/50* (2013.01)

(58) Field of Classification Search
CPC ..... A61J 1/1412; A61J 1/1418; A61J 1/1425; A61J 7/04; A61J 2205/50
USPC ..... 116/308–326; 40/5, 310, 311, 633; 206/534
See application file for complete search history.

(56) References Cited

U.S. PATENT DOCUMENTS 579,474 A * 3/1897 De Barry ..... A61J 7/04 116/308
2,111,637 A * 3/1938 Mehaffey ..... A61J 7/04 116/308
3,700,095 A * 10/1972 Dangles et al. ..... A61J 7/04 116/308
3,921,568 A * 11/1975 Fish ..... G07C 1/00 116/308
4,041,628 A * 8/1977 Sasson ..... G09D 3/10 116/308
4,148,273 A * 4/1979 Hollingsworth et al. A61J 7/04 116/325
4,345,541 A 8/1982 Villa-Real
4,347,804 A * 9/1982 Villa-Real ..... A61J 7/04 116/308
4,473,156 A * 9/1984 Martin ..... A61J 7/04 116/308
4,883,180 A 11/1989 Humphrey et al.
4,913,083 A 4/1990 Valvo et al.
5,009,338 A 4/1991 Barker
5,011,032 A 4/1991 Rollman
5,261,702 A * 11/1993 Mayfield ..... A61J 7/04 283/115
5,279,422 A 1/1994 Adams
5,358,117 A 10/1994 Adams
5,577,335 A * 11/1996 Tucker ..... A47B 23/044 116/309

(Continued)

*Primary Examiner* — R. A. Smith
(74) *Attorney, Agent, or Firm* — Kagan Binder, PLLC

(57) ABSTRACT

Described herein is a 3-dimensional interchangeable icon bottle cap assembly, or cap with textured indicia, with top plates that interface with prescription bottle caps using icons, graphics and colors that help patients understand when to take their medication, what the medication is for, and provide the ability to keep track of medication compliance.

16 Claims, 13 Drawing Sheets

(56) References Cited

U.S. PATENT DOCUMENTS 5,660,138 A 8/1997 Hirsch
5,683,718 A * 11/1997 Errigo ..... A61J 3/007 424/464
5,729,922 A * 3/1998 Peterson et al. ..... G09F 23/08 40/324
5,730,292 A * 3/1998 Jones ..... B01L 3/50825 206/459.5
5,778,818 A * 7/1998 Marshall ..... A61J 7/04 116/309
5,803,283 A 9/1998 Barker et al.
6,227,371 B1 5/2001 Song
6,386,367 B1 * 5/2002 Bayliss, IV ..... A61J 1/03 206/459.5
6,545,592 B2 4/2003 Weiner
6,769,545 B1 * 8/2004 Mallams ..... A61J 7/04 206/459.5
6,779,480 B2 8/2004 Zamjahn
7,017,762 B2 3/2006 Shane
7,118,007 B1 10/2006 Yates et al.
7,137,528 B1 11/2006 Yates et al.
7,314,022 B2 1/2008 Sollaccio
7,320,483 B2 * 1/2008 Eippert ..... B42D 15/00 206/534
7,369,919 B2 5/2008 Vonk et al.
7,556,151 B2 7/2009 Seijas
7,907,477 B2 3/2011 Puzia
7,956,727 B2 6/2011 Loncar
7,978,564 B2 7/2011 De La Huerga
8,056,724 B2 11/2011 Estep
8,138,939 B2 3/2012 Manning et al.
8,193,918 B1 6/2012 Shavelsky et al.
8,201,691 B1 6/2012 Chowdhury
8,224,667 B1 7/2012 Miller et al.
8,336,917 B2 12/2012 Doiron
8,356,434 B2 1/2013 Alipour
8,391,104 B2 3/2013 de la Huerga
8,456,287 B2 6/2013 Gifford et al.
8,534,220 B1 * 9/2013 Olson ..... G09F 11/23 116/308
8,538,775 B2 9/2013 Skomra
8,781,856 B2 7/2014 Hanina et al.
8,797,167 B2 8/2014 Bangera et al.
2002/0162261 A1 11/2002 West et al.
2004/0216340 A1 11/2004 Woods et al.
2006/0154642 A1 7/2006 Scannell, Jr.
2007/0056503 A1 3/2007 Sollaccio
2007/0186452 A1 * 8/2007 Hirth ..... G09F 3/14 40/310
2009/0090688 A1 4/2009 Fruchter
2009/0230015 A1 * 9/2009 Harrison ..... B65D 21/0204 206/571
2009/0242452 A1 10/2009 Perry
2010/0038279 A1 2/2010 Estep
2010/0042430 A1 2/2010 Bartfeld
2010/0169111 A1 7/2010 Brue et al.
2011/0101016 A1 5/2011 Luciano, Jr.
2012/0152796 A1 * 6/2012 Leon Alonso et al. . A61J 1/035 206/531
2013/0096953 A1 4/2013 Beverly et al.
2014/0231301 A1 * 8/2014 Herbert et al. ..... A61J 1/03 206/534
2014/0299504 A1 * 10/2014 Sena ..... A61J 1/03 206/534

* cited by examiner

PRESCRIPTION BOTTLE CAP ASSEMBLY AND MEDICATION MANAGEMENT SYSTEM

CLAIM OF PRIORITY

This application claims the benefit of and claims priority to U.S. Provisional Application No. 61/985,043, filed Apr. 28, 2014, the entire disclosure of which is hereby incorporated by reference.

FIELD OF THE INVENTION

The invention relates generally to prescription bottle caps and medication management for a patient.

BACKGROUND

Pills, capsules, liquids and other medicines have long been packaged in bottles or other containers capped with a variety of closure devices. Prescription bottle caps are designed to serve multiple purposes including preventing moisture and foreign materials from entering the bottle and contaminating the medicine in the bottle. Prescription bottle caps have also been designed to prevent children from gaining access to the medication.

The medicine prescribed often must be taken at particular intervals and dosage levels. Failure to take medicine as prescribed or directed can delay the relief afforded by the medicine and can lead to even more serious problems. The problems associated with maintaining a prescribed schedule for taking medicine are especially prevalent amongst the elderly. Often older patients must take multiple medicines each day and the time tables for different prescriptions may vary. Many older people overmedicate themselves because of confusion arising from having varying schedules for different medicines.

Some of prior art solutions to these challenges recognize the desirability of keeping manufacturing costs low due to the often disposable aspect of such medication containers and caps. Some prior art medicine caps have time indicating numbers marked or imprinted in a circumferential manner along the upper edge of the cap, with one or two hands positioned to point to the numeral or numerals representing the hour at which the next medication is to be taken. Some inventors of prior art devices have recognized that such arrows or hands are subject to accidental rotation away from the correct hour and have attempted to avoid this problem by utilizing friction to discourage involuntary rotation. However, the time setting mechanisms of prior art devices are not readily usable by elderly persons who may have trouble manipulating small devices with often arthritic hands. Motor control is also problematical for persons disabled through stroke or other paralysis of the upper limbs. Further the use of printing on the bottle cap to indicate time and dosage can be difficult for the visually impaired to read or the label may have been poorly printed. Some other solutions attempt to rely solely on standard prescription pill bottles with pharmacy generated labels, but these solutions are not meeting the needs of the market because for many elderly and sight limited patients, trying to read the small type on the prescription bottle labels is very difficult or nearly impossible.

Solutions have been proposed in the past for managing prescription medications, such as the one described in U.S. Pat. No. 5,358,117 by Adams, which provides the patient a date-timer mechanism that resides on the bottle cap for tracking the time for the next dosage. Although useful, this particular approach apparently has not gained commercial success. Other solutions attempt to utilize various pill holders and boxes, but these solutions are similarly unable to meet the needs of the market because the pill holders can indicate when to take the pills but when multiple pills are together the patient does not remember which pill is for which condition. Still other solutions seek to utilize bottles, which use a color-coding system to the pill bottles, but these solutions also fail to meet market needs because it is easy to forget what a color represents. Due to additional component costs, many of these approaches do not appear to have been implemented by the pharmacies nor by the pharmaceutical manufacturers and the patient unfortunately has had to accept the status quo.

SUMMARY

The invention described herein, in one embodiment, uses a visual and tactile reminder like a raised or textured image or character to help identify or correlate medication with a particular condition. It would therefore be advantageous to have an improved prescription bottle cap having a time of dosage, dosage amount and type of medication indicator or indicia which may be easily glanced or set by an elderly person or a person visually impaired or otherwise disabled. It would also be advantageous, as described herein, to have an apparatus that is a reminder prescription bottle cap assembly covering that allows attachment of a 2 or 3-dimensional part which comes in different designs. Furthermore, it would also be advantageous, as described herein, to have an apparatus available with Braille as an option. Still further, it would be advantageous, as described herein, to have an apparatus that has a medication compliance feature to keep track of the last dose taken. Therefore, there currently exists a need in the market for an apparatus that is a prescription bottle cap or cap assembly covering that uses textured icons, images, indicia, graphics, shapes, letters, and colors to help patients understand when to take their medication, what the medication is for, and when the medication was last taken.

The various embodiments of the invention advantageously fill the aforementioned deficiencies by providing a (2 or) 3-dimensional interchangeable parts assembly that interface with prescription bottle caps using textured indicia, icons, graphics and colors that help patients understand when to take their medication, what the medication is for (which provides customizable information) and provides the ability to keep track of compliance. In an alternative embodiment, the 3-dimensional interchangeable parts are integrated into the prescription bottle cap.

In an example embodiment, Braille is located on the top of the cap. In another embodiment, the symbols are not color-dependent for users who are color blind. The cap assembly and medication management system have the ability to help patients know what the medication is for and when to take it, or when they last took the medication in an instant through visual information/symbols versus having to read the small print on the label.

The apparatus and system described herein fulfill the need for relaying the most essential data to the medication user with easy to read (or visualize) icons to indicate both time and purpose of medications. The interchangeable bottle tops provide customization to users, catering to the widest range of people possible.

Among other things, it is an advantage of the invention to provide 3-dimensional (or 2) interchangeable parts that interface with prescription bottle caps using icons, graphics, shapes, letters, and colors that help patients understand when to take their medication, what the medication is for, and allows for customizable information and the ability to keep track of compliance that does not suffer from any of the problems or deficiencies associated with prior solutions. It is still further an advantage of the invention to optimize medication compliance, minimize medication confusion, and help patients understand what their medication is for.

In one example embodiment, a cap is provided for a medicine container configured as a medication intake reminder, the cap having a body which has an upper surface and an underside surface, the upper surface having a first textured indicia representing a medical condition to be treated and a second textured indicia representing a time of day a medication is to be taken by a patient. The cap or cap assembly also includes a gripping mechanism disposed on the underside surface of the body for attaching the body to a medicine container. In this example embodiment, the at least one of the textured indicia is raised from the upper surface and the textured indicia is inscribed on the upper surface. In a related embodiment, a rotatable disk assembly is located on the upper surface, the disk assembly including a textured indicia representing a duration or time period for taking a medicine dosage. In addition, the rotatable disk assembly is comprised of an inner disk and an outer ring disposed around the inner disk, wherein the inner disk is configured to rotate at least clockwise about the upper surface of the body or cap.

In another example embodiment, a cap assembly is provided for a medicine container configured as a medication intake reminder, the cap assembly includes a top plate having an upper surface and an underside surface, the upper surface having a first textured indicia representing a medical condition to be treated and a second textured indicia representing a time of day a medication is to be taken by a patient. The cap assembly also has a base plate having a gripping mechanism disposed on an underside surface of the base plate, the base plate configured to have at least one attachment mechanism on the top surface of the base plate to receive and attach the top plate, wherein the gripping mechanism is configured to attach the base plate to one of a medicine container and a standard prescription bottle cap. In another embodiment, at least one of the textured indicia is raised from the upper surface of the top plate and is adapted to be removably attached to the top plate and can be configured to be inscribed on the upper surface of the top plate. In this embodiment, the top plate is configured to be rotatable about the top surface of the base plate, the top plate including textured indicia representing a duration or time period for taking a medicine dosage.

In yet another example embodiment, a cap or cap assembly is provided for a medicine container configured as a medication intake reminder, the cap including a textured indicia assembly having an upper body and a fastening mechanism attached underneath, the upper body having a first textured indicia representing a medical condition to be treated. The cap assembly also has an elongate slot on a surface of the cap configured to receive the fastening mechanism, thereby attaching the textured indicia assembly to the medicine container cap surface. In this example embodiment, the indicia assembly has a second textured indicia representing a time of day a medication is to be taken by a patient.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1A:
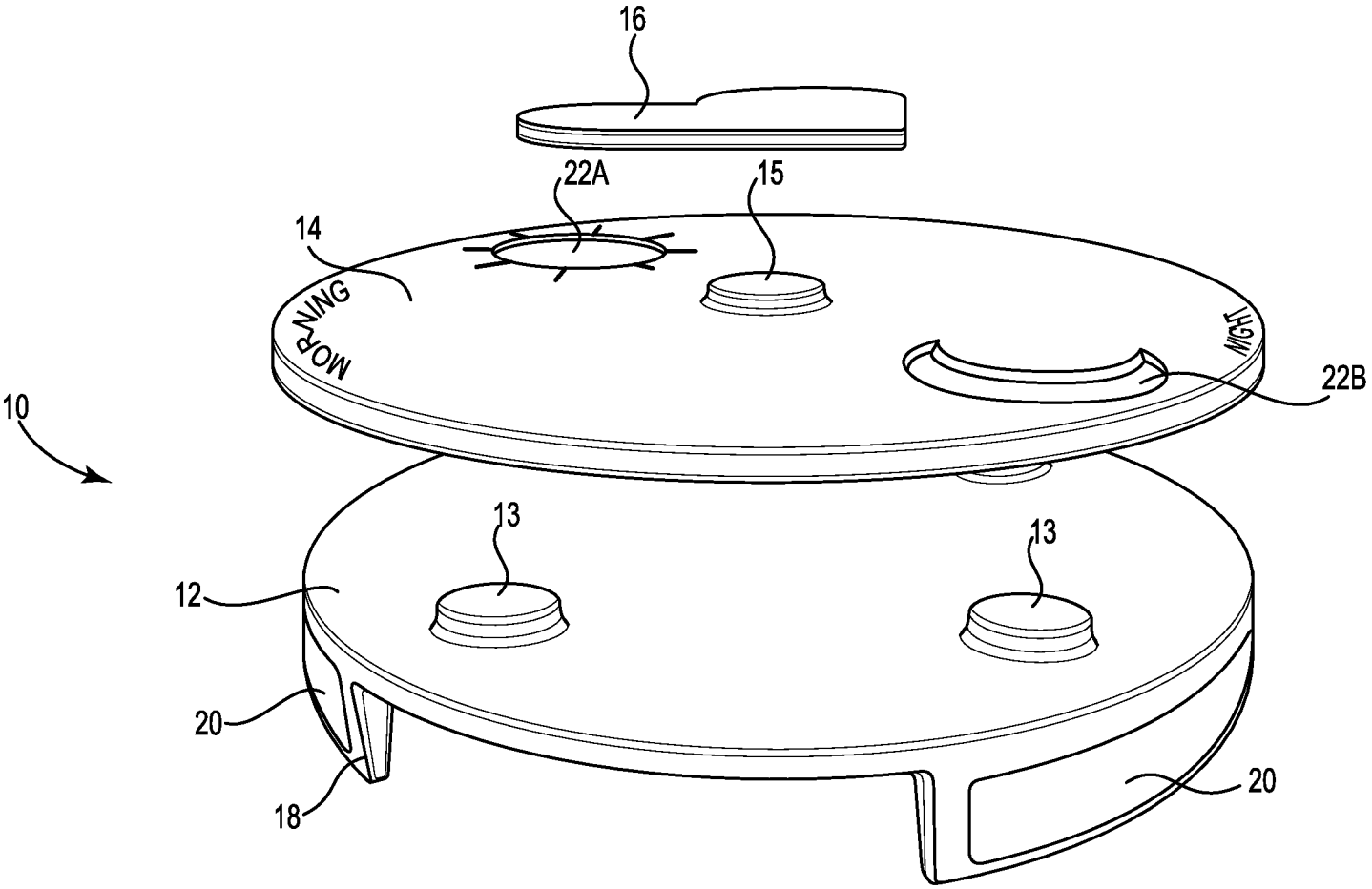
FIGS. 1A-1D illustrate exploded, side, assembled and bottom views of a prescription bottle cap assembly configured for use on a standard bottle cap as taught herein.
Figure 1B:
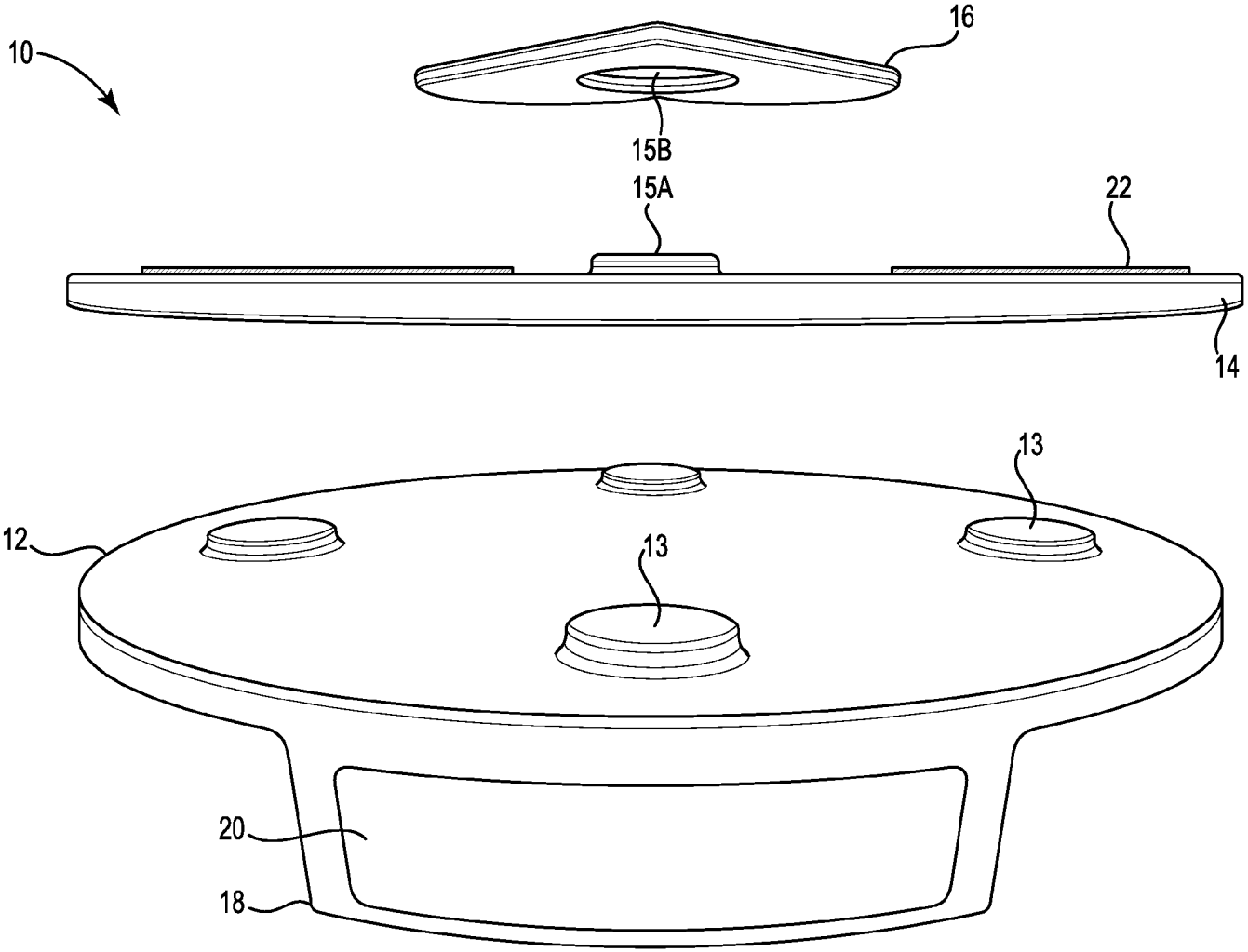
Figure 1C:
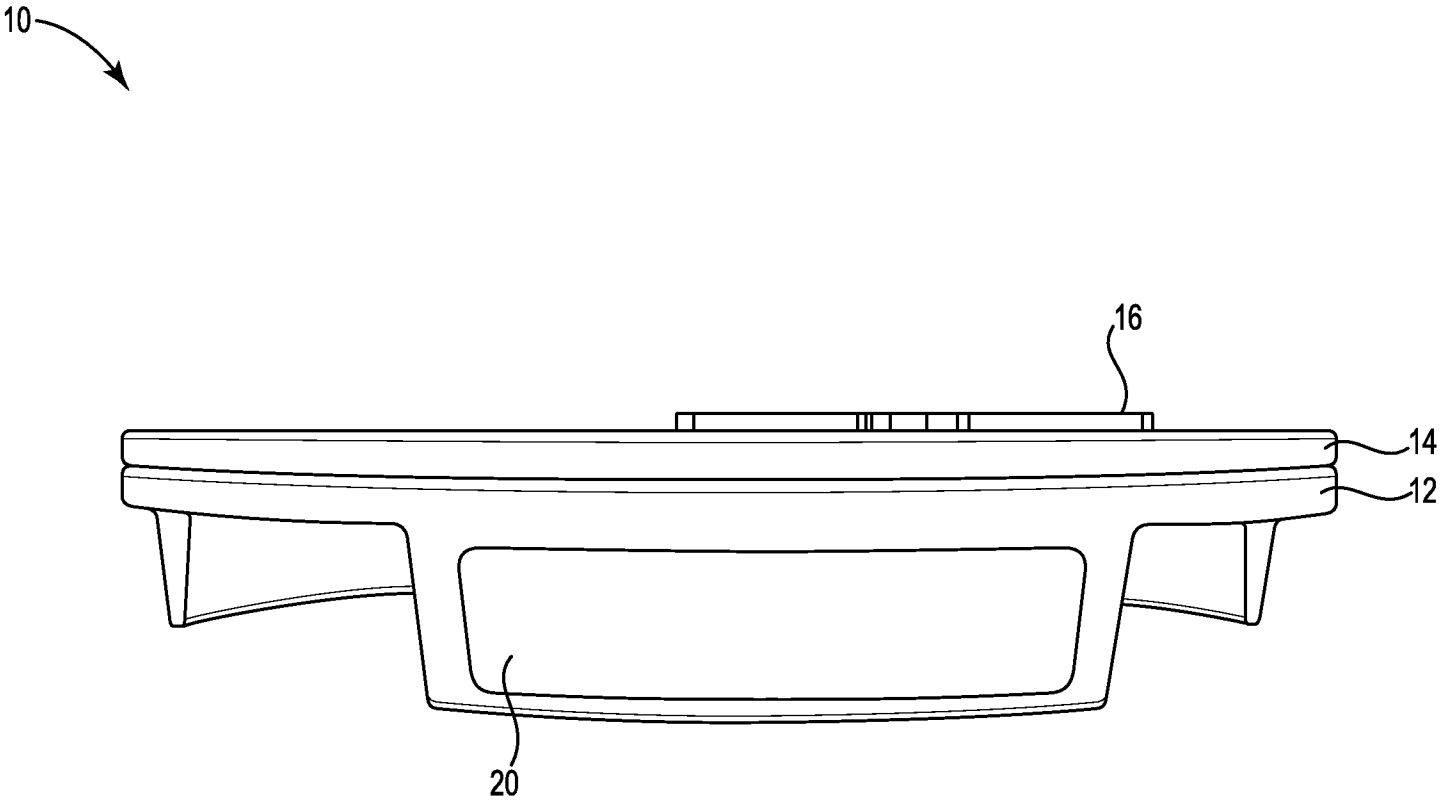
Figure 1D:
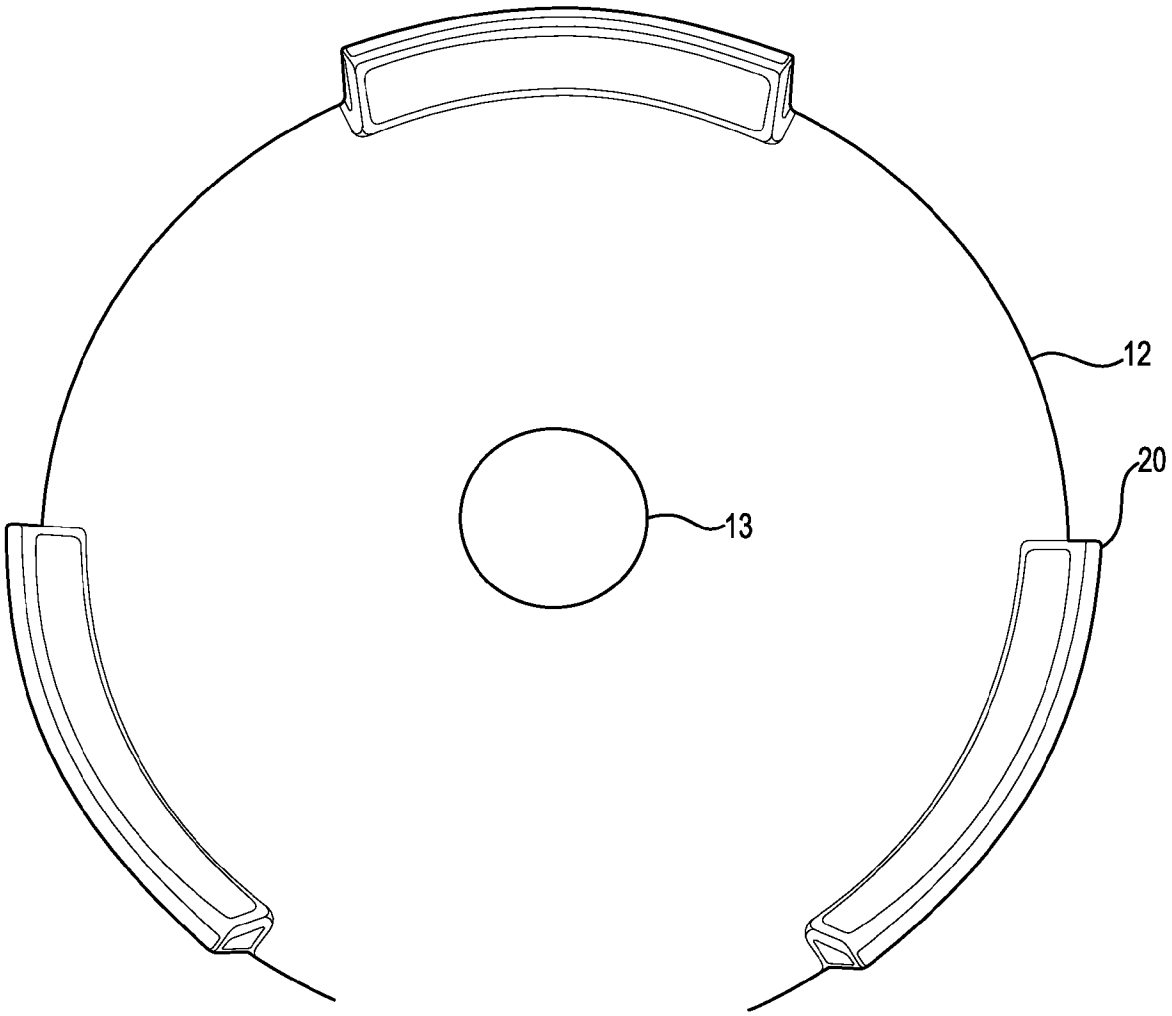

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

The various embodiments of the invention are directed to a 3-dimensional (or 2) or textured icons or indicia that are disposed on a bottle cap top that interfaces with standard prescription bottle caps in the form of textured icons, indicia, graphics, symbols, shapes, letters, text, Braille symbols and colors that help patients understand when to take their medication, what the medication is for, and provide the ability to keep track when doses were taken (or are to be taken).

The various embodiments of the invention include a prescription bottle cap covering with an interface, which allows attachment of a 3-dimensional icon that illustrates when the medication was taken. For example, a disk may have an icon of the "sun" to indicate a morning dose. Another icon interfaces on top depending on what the medication is for, such as a "heart" for cardiovascular drugs.

The device may also include another cap covering comprising a window that rotates to illustrate when the last dose was taken. In an example embodiment, the cap coverings can come in Braille. In yet another embodiment, a photo of the patient can be added if there is more than one medication user in a home.

Referring to the figures, FIGS. 1A-1D illustrate exploded, side, assembled and bottom views, respectively, of a prescription bottle cap assembly configured to fit on a standard bottle cap in connection with a standard prescription pill bottle. In this example embodiment, a bottle cap top assembly 10 includes up to two or more interchangeable plates. In one example embodiment, a first plate is a base plate 12 that includes attachment pads 13 and attachment grip members 20 (with a downwardly protruding portion 18) that allow base plate 12 to attach to the bottle cap that comes with the prescription bottle. Attachment pads (or a single pad can be used) 13 are configured to join with corresponding indents (not shown underneath) in a top plate 14 to secure top plate 14 to base plate 12 that is mounted on the prescription cap. In an alternative embodiment, base plate 12 is integrated with a bottle cap as a single unit and can use attachment pads 13 formed thereon to secure top plate 14.

In this example embodiment, a second plate is top plate 14 which includes a set of icons 22 that relay pertinent information to a patient. For example, icons 22 may indicate what time of day the medication is to be taken by illustrating a sun 22A, star, moon 22B or other similar time of day icon. Referring to a sample listing of icons 22, FIGS. 3A-3H illustrate icons to indicate or suggest what medical condition the medication is for by illustrating, for example, a "heart" (FIG. 3A) for heart medication, "lungs" (FIG. 3A) for cardiovascular medication, a "V" (FIG. 3A) for vitamin, a "brain" for headache or migraine medication, a "neck with thyroid" (FIG. 3A) for thyroid medication, a "stomach" (FIG. 3A) for gastrointestinal medication, a drop (FIG. 3A) for blood or diuretic a "lightning bolt" (FIG. 3A) for pain medication, a "tissue box" (FIG. 3A) or someone sneezing for allergy medication, a "blood pressure device" (FIG. 7) and other similar icons. In a related embodiment, icons 22 may be integrated within the plates or may be interchangeable with a locking mechanism on the top of top plate 14. Icons 22 (time of day or medical condition icons) may also be color coded and/or include text, symbols, letters, or Braille.

In this example embodiment, top plate 14 includes a spinning wheel (or moving slot) to record when the medication was taken. In the case of a moving slot, plate 12 may include the days of the week imprinted on its surface. For example, the top plate 14 may include the days of the week or the time of the day if medication is to be taken more than one time per day. In related embodiments, top plate 14 may further comprise icons 22 that indicate which patient the medication is for. Icons 22 may indicate the patient I.D. through a photo of the patient or a symbol (or initials) that corresponds to a particular patient.

Figure 4A:
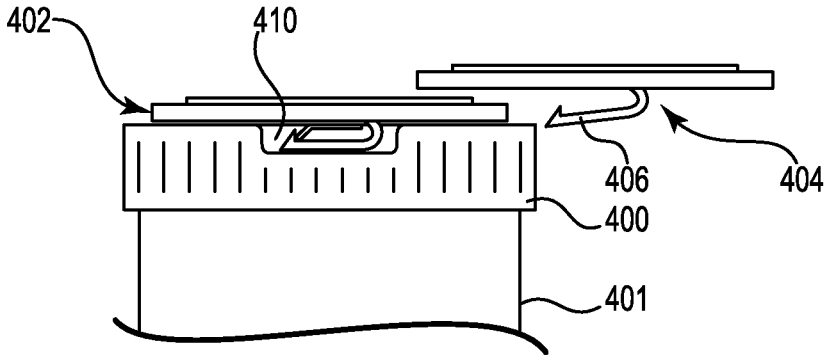
FIGS. 4A-4B illustrate another example embodiment of adhering medical condition icons to a prescription bottle cap assembly as taught herein.
Figure 4B:
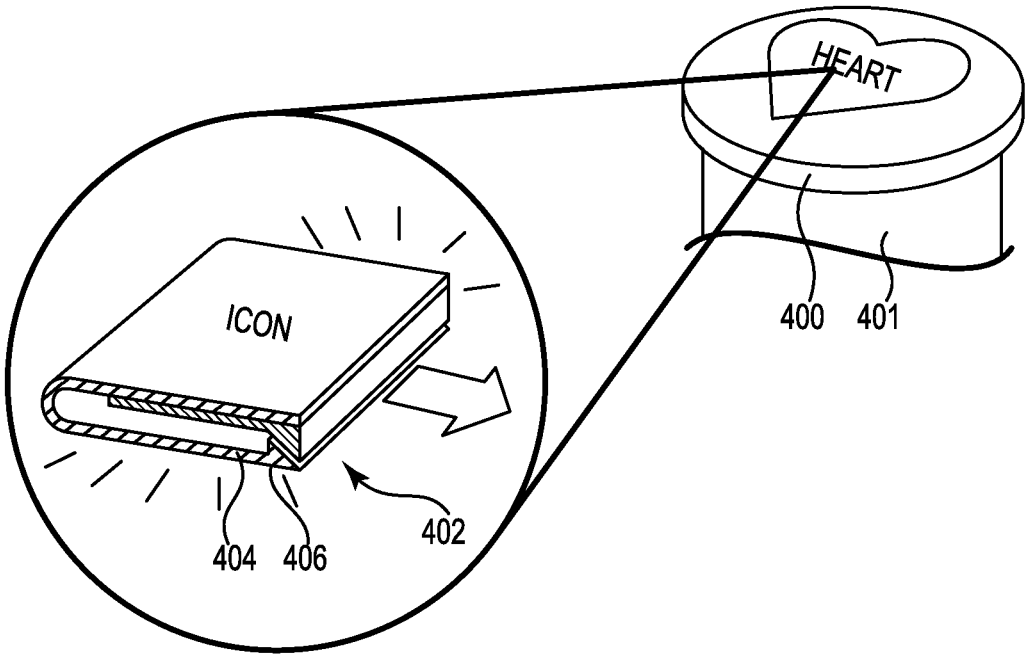

Referring again to FIGS. 1A-1D, an icon plate 16 for a particular medical condition is snapped on to top plate 14 by way of a protrusion/indent combination 15, wherein the indent on icon 16 is designated 15A and the protrusion or nub is designated 15B. In this example embodiment, the medication is for a heart related ailment. Referring briefly to FIGS. 4A-4B, there is illustrated another example embodiment of adhering or attaching medical condition icons to a prescription bottle cap. In this example embodiment, there is illustrated a method of attaching an icon plate 402 to a bottle cap 400 that is attached to a bottle 401 by way of sliding the back of the icon 402 onto the cap using an elongated member 404 with a clip 406 that is slid into and snaps into place in a slot 410 of cap 400.

Figure 7:
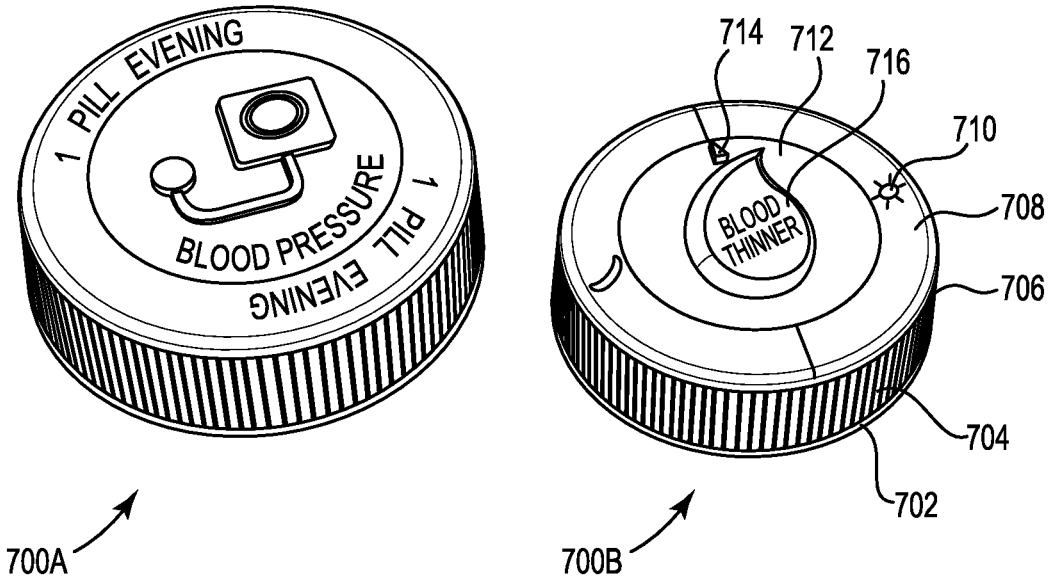
FIG. 7 illustrates two prescription bottle cap assemblies of differing sizes as taught herein.
Figure 8:
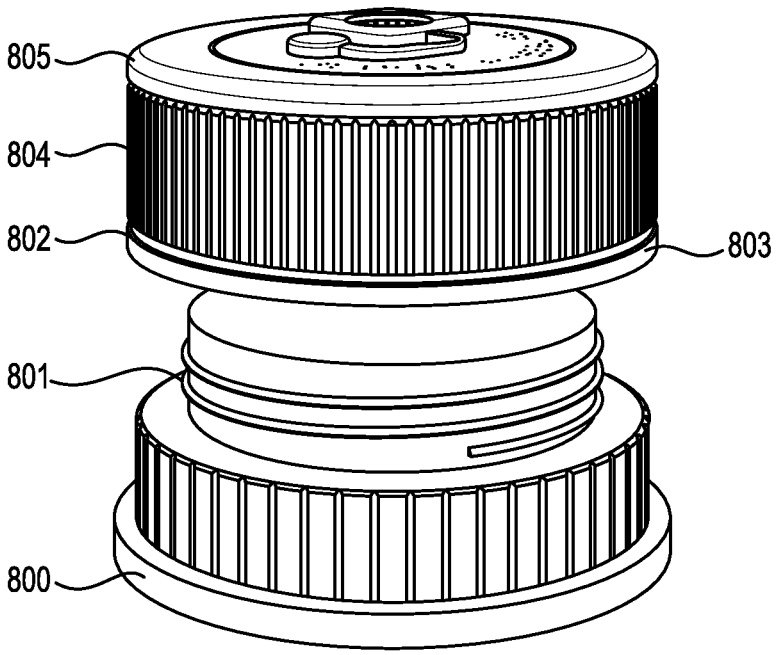
FIG. 8 illustrates another example embodiment of prescription bottle cap assembly configured to be threaded on another standard bottle cap having an upper thread as part of the bottle cap body as taught herein.

In related embodiments, base plate 12 and top plate 14 may come in different sizes to accommodate different size prescription bottles (see FIG. 7 and FIG. 8 for examples of differing cap assembly sizes). Attachment pads 20 may also be capable of attaching to different size prescription bottle caps. Such attachment pads 20 may be by snap fit engagement, adhesive, screw/thread fit, or other attachment mechanism commonly known in the art.

Figures 2A, 2B, 2C:
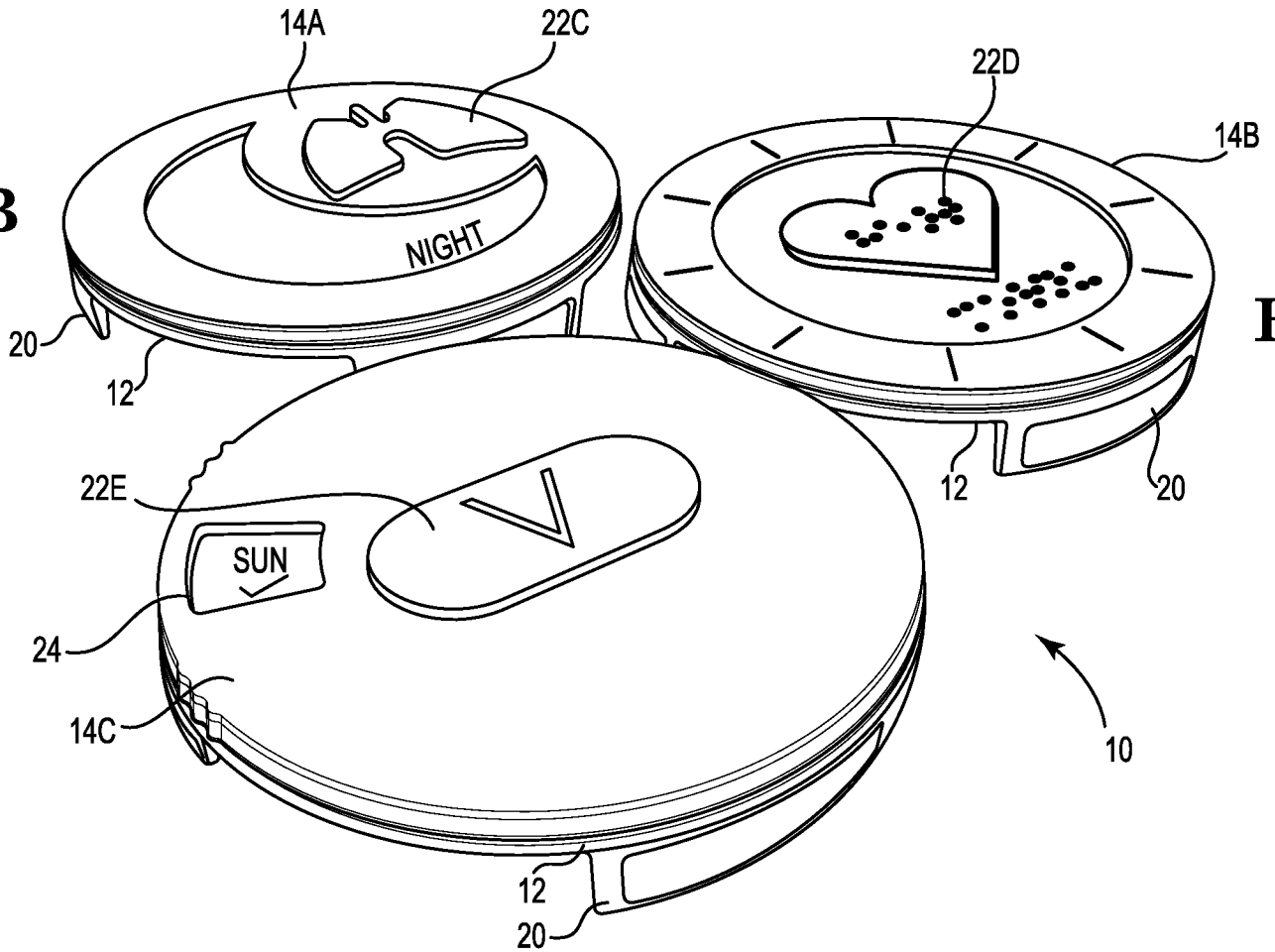
FIGS. 2A-2C illustrate other example embodiments of prescription bottle cap assemblies as taught herein.
Figure 3A:
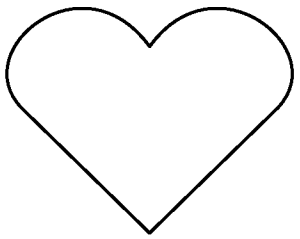
FIGS. 3A-3H illustrate icons or indicia associated with various medical conditions that would be disposed on a prescription bottle cap assembly as taught herein.
Figure 3B:
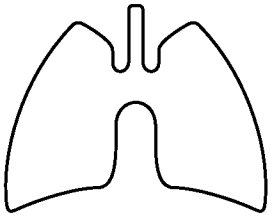
Figure 3C:
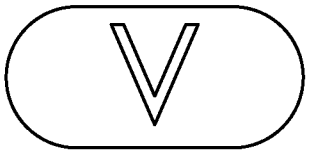
Figure 3D:
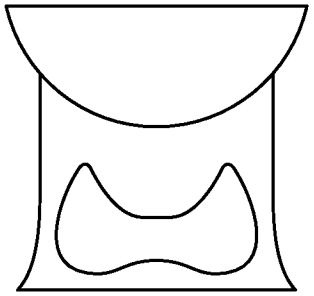
Figure 3E:
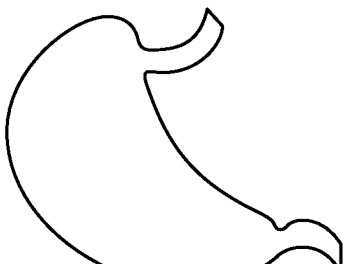
Figure 3F:
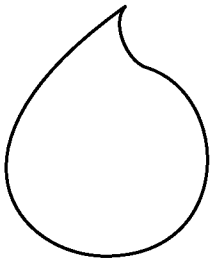
Figure 3G:
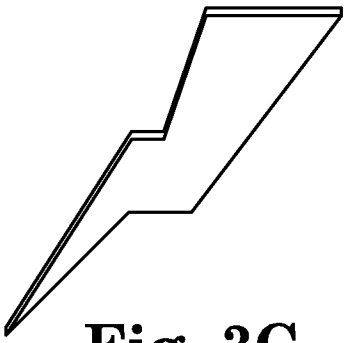
Figure 3H:
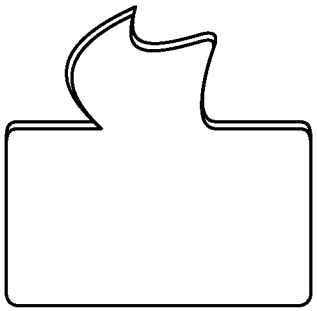

FIGS. 2A-2C illustrate example embodiments of different top plates 14A, 14B, and 14C. For example, top plate 14A illustrates an example icon 22C that indicates type of medication and what time of day to take the medication. Top plate 14B includes icon 22D type of medication and includes Braille for communication with the visually impaired. Top plate 14C includes icon 22E for a vitamin and illustrates an example of a spinning wheel with a window 24 to indicate when the medication was taken or should be taken.

In an example embodiment, top plate 14 may be capable of rotating relative to base plate 12. In yet another example, plate 14 has a movable slide or slot to reveal the day of the week. Bottle cap top 10 may be made from materials commonly known in the art such as, but not limited to, plastic, acrylic, or rubber.

In an example embodiment, bottle cap top 10 may come in a variety of forms: an aftermarket product that can be attached to any prescription bottle cap, any over the counter supplement bottle cap, or any prescription product that does not necessarily have a bottle cap, like an inhaler asthma pump. Another example embodiment includes a direct attachment device for the prescription bottle or aftermarket bottle caps that function as a regular prescription bottle cap. In various embodiments, icons 22 may be printed utilizing 3-dimensional printing or 2-dimensional printing.

Figure 5B:
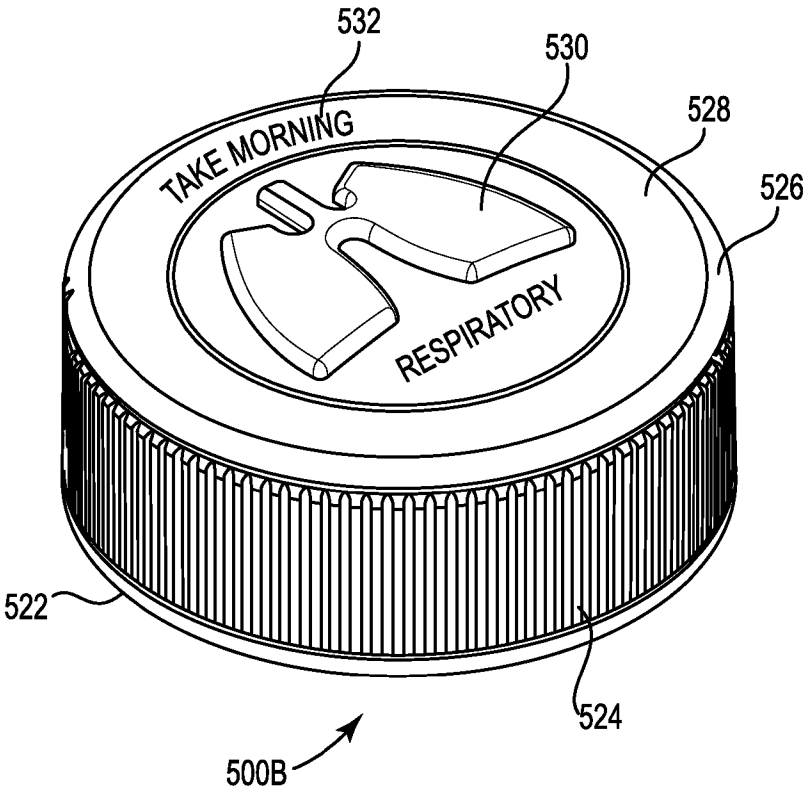
FIGS. 5A-5B illustrate views of other prescription bottle cap assemblies indicating dosage time and icons or indicia representing the type of medical condition being treated as taught herein.
Figure 5A:
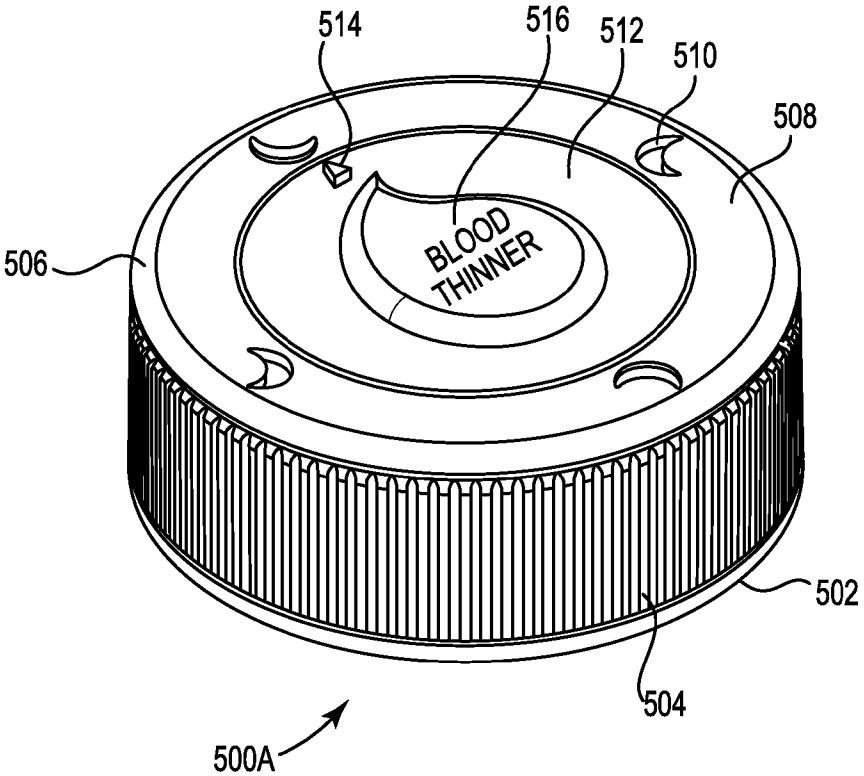

Referring now to FIGS. 5A-5B there are illustrated views of example embodiments of other prescription bottle cap assemblies 500A and 500B for indicating dosage time and icons or indicia representing the type of medical condition being treated. Referring to cap 500A, there is a cap body 502 with external gripping ribs 504 (in another embodiment, the ribs is replaced with a plurality of nubs or bumps to enhance gripping) and a top portion 506. Top portion 506 includes a ring 508 with one or more time of day icons 510 (either cut-out or imprinted), an inner disk 512, an arrow or indicator 514 and a medical condition icon 516. In this example embodiment, inner disk 512 is rotatable in a clockwise or counterclockwise fashion to point to a time of day icon. This embodiment provides the patient with a quick visual recognition of the type of medication and dosage time without having to look for reading glasses to read the cap or the label.

Referring now to cap 500B, there is a cap body 522 with external gripping ribs 524 (in another embodiment, the ribs is replaced with a plurality of nubs or bumps to enhance gripping) and a top portion 526. Top portion 526 includes a ring 528 (stationary in this example) with large time of day lettering written in the patient's native language 532 and a medical condition icon 530, which can also be described in written form. This example embodiment provides the patient with a quick visual recognition of the type of medication and dosage time without having to look for reading glasses to read the cap or the label.

Figure 6A:
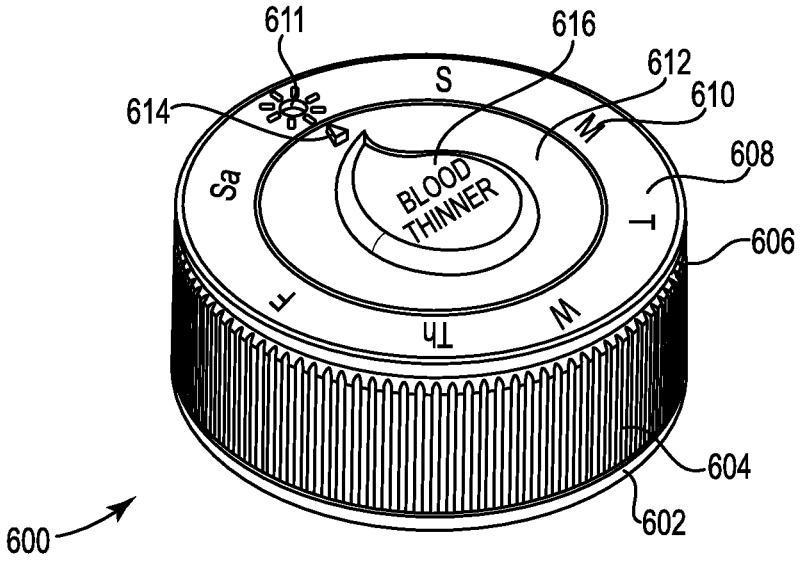
FIGS. 6A-6E illustrate multiple piece prescription bottle cap assemblies as taught herein.
Figure 6B:
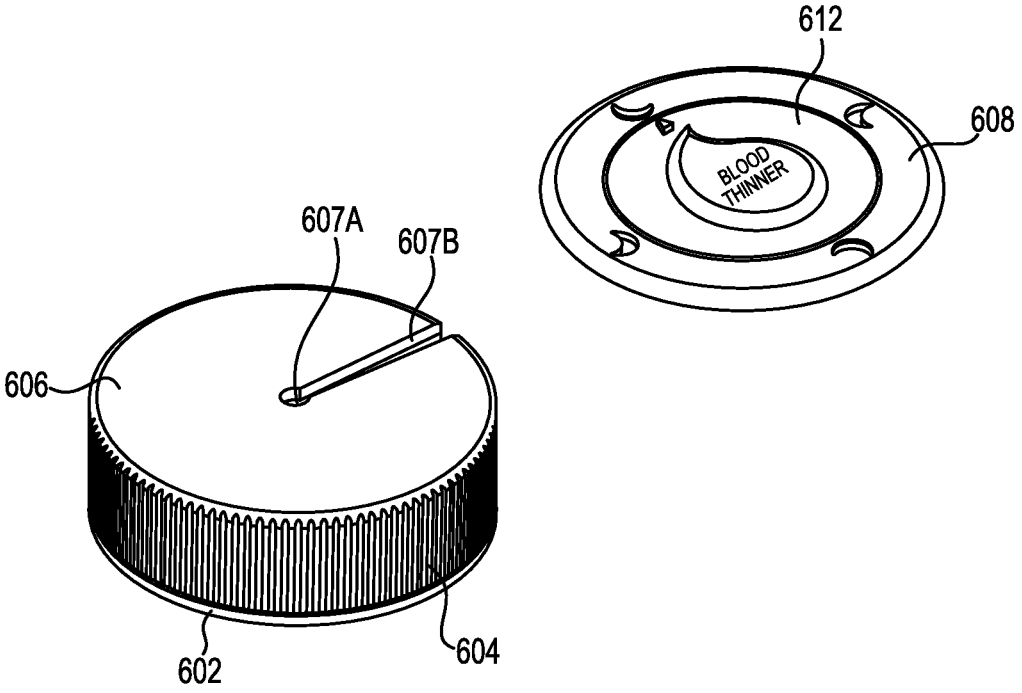
Figure 6C:
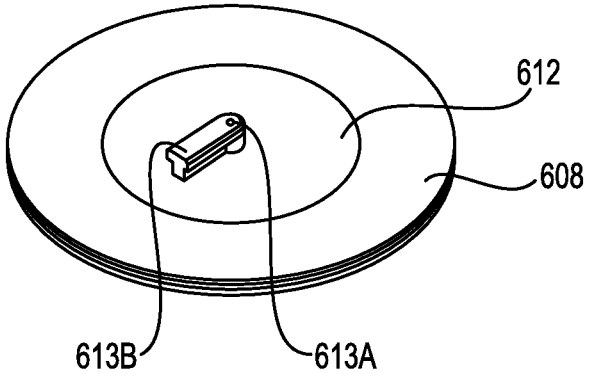
Figure 6C:
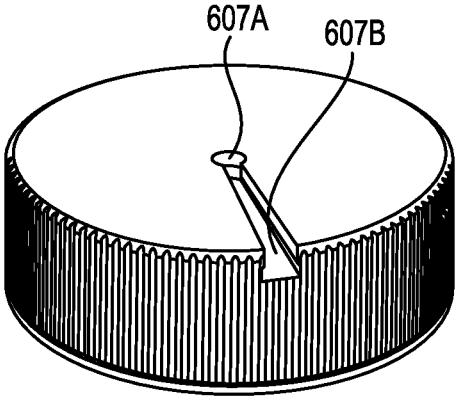
Figure 6D:
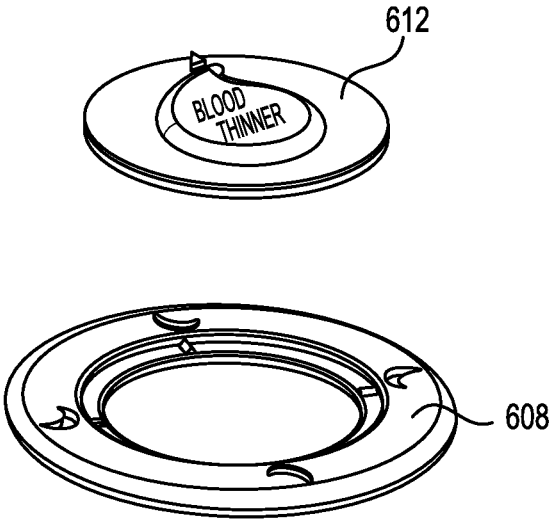
Figure 6E:
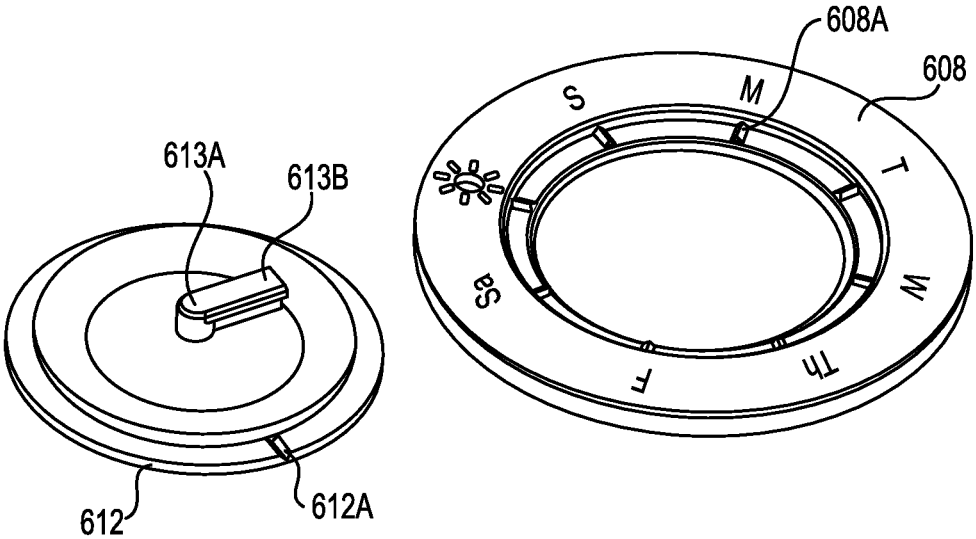

Referring now to FIGS. 6A-6E, there is illustrated another multiple piece prescription bottle cap assembly as taught herein. Referring to cap assembly 600, there is a cap body 602 with external gripping ribs 604 (in another embodiment, the ribs is replaced with a plurality of nubs or bumps to enhance gripping) and a top portion 606. Top portion 606 includes a ring 608 with one or more day of the week icons 610 (either cut-out or imprinted) and time of day icon/indicia 611, an inner disk 612, an arrow or indicator 614 and a medical condition icon 616. In this example embodiment, inner disk 612 is rotatable in a clockwise or counterclockwise fashion to point to a day of the week indicia or text. This embodiment provides the patient with a quick visual recognition of the type of medication and dosage time, with day tracking capability, without having to look for reading glasses to read the cap or the label. FIGS. 6B and 6C illustrate cap assembly 600 separated into two components, namely cap body 602 and ring disk 608, and how they fit together via a slot 607 comprised of a hole 607A and a channel 607B disposed on top portion 606 that fits with a clip 613 having portions 613A and 613B that mate with slot 607. FIGS. 6D and 6E illustrate ring disk 608 separated into its two components, namely ring disk 608 and inner disk 612. Inner disk 612 from the view of the underside has a notch 612A that is configured to engage one of the ribs 608A on ring disk 608 to help keep track of the day the medication was taken when ring disk 608 is rotated. In a related embodiment, the inner disk and the ring disk are both rotatable to track a 7 day and/or a 14 day duration or time period for the recommended dosage to help the patient track the dosage taken over a 7 or 14 day period.

Referring now to FIG. 7 there is illustrated two prescription bottle cap assemblies 700A and 700B of differing sizes to accommodate bottles or bottle caps of differencing sizes. Cap assembly 700A is similar in construction to cap 500B described above but illustrates a "blood pressure" medical condition icon and easy to read large text with a contrasting background. Referring now to cap 700B, there is a cap body 702 with external gripping ribs 704 (in another embodiment, the ribs is replaced with a plurality of nubs or bumps to enhance gripping) and a top portion 706. Top portion 706 includes a 2-piece ring 708 with one or more time of day icons 710 (either cut-out or imprinted) with dual coloring to further distinguish the two icons (day and night; sun and moon), an inner disk 712, an arrow or indicator 714 and a medical condition icon 716. In this example embodiment, inner disk 712 is rotatable in a clockwise or counterclockwise fashion to point to a time of day icon. This embodiment provides the patient with a quick visual recognition of the type of medication and dosage time without having to look for reading glasses to read the cap or the label.

Referring now to FIG. 8 there is illustrated another example embodiment of prescription bottle cap assembly 802 configured to be threaded on another standard bottle cap 800 having an upper thread 801 as part of the bottle cap body. Cap 802 has a body 803 that is configured with a thread underneath (not shown) that mates with upper thread 801. In this example embodiment, cap 802 includes ribs 804 for gripping and an upper assembly 805 is as an intake reminder assembly (time of day or day of the week and medical treatment image) or can be any combination of the various types described with other embodiments. Generally, this approach allows for an aftermarket adaptation of cap 802 to standard pill bottles and caps.

Figure 9A:
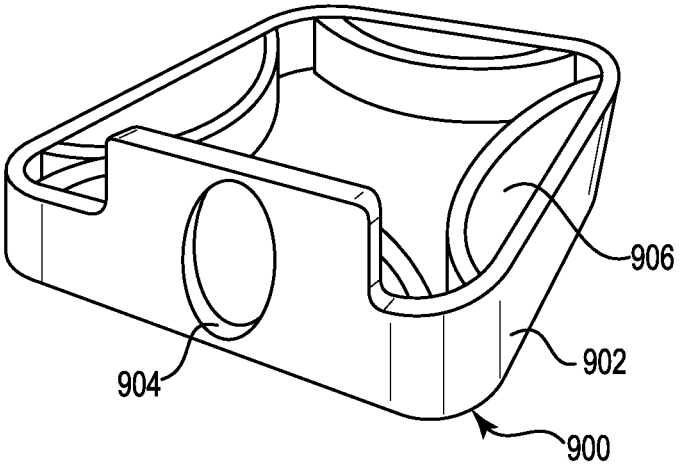
FIGS. 9A-9C illustrate various views of an example embodiment of a prescription bottle docking station that is configurable to be joined with other docking stations as taught herein.
Figure 9B:
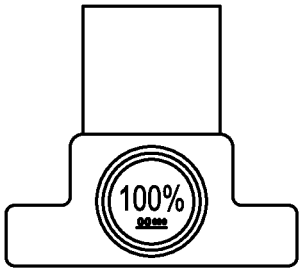
Figure 9C:
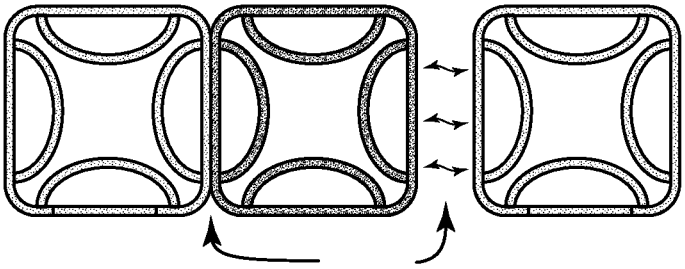

Referring now to FIGS. 9A-9C there are illustrated various views of an example embodiment of a prescription bottle docking station or medicine cradle 900 that is configurable to be joined with other docking stations. Docking station 900 includes a body 902 and a display 904 that displays information from a prescription bottle placed therein. In this example embodiment, docking station 900 also includes a gripping mechanism 906 comprised of one or more flexible silicone bands that provide tension and a gripping action for the prescription bottle that is placed between the bands. In a related embodiment, gripping mechanism 906 is comprised of a plurality of fins that project inward from the sidewalls of body 902. FIG. 9B illustrates a prescription bottle placed in body 902 with display 904 displaying the compliance of the patient with respect to the medication. FIG. 9C illustrates a top view of how various bodies 902 can be joined together to form an array of docking stations with each of the medications. In this example embodiment, metal bodies 902 that are magnetized are used to join the units together. In another embodiment, bodies 902 are made of other materials and hook and loop fasteners are used to join together the various bodies or bases 902.

Various related embodiments of the invention are also described in Appendix A, which is incorporated herein by reference in its entirety. The following patents are incorporated by reference in their entireties: U.S. Pat. Nos. 5,660,138; 6,545,592; and 8,336,917.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A cap for a medicine container configured as a medication intake reminder, the cap comprising:
   - a body having an upper surface and an underside surface, the upper surface having a first textured indicia representing a medical condition to be treated and a second textured indicia representing a time of day a medication is to be taken by a patient, wherein at least one of the textured indicia is raised from the upper surface;
   - a gripping mechanism disposed on the underside surface of the body for attaching the body to a medicine container; and
   - a rotatable disk assembly located on the upper surface, the disk assembly including a textured indicia representing a duration or time period for taking a medicine dosage;
   - wherein the upper surface of the cap includes a slot configured to receive an elongate clip member located on a bottom surface of the disk assembly, thereby joining the disk assembly to the upper surface of the cap.

2. A cap as defined in claim 1 wherein at least one of the textured indicia is inscribed on the upper surface.

3. A cap as defined in claim 1 wherein the rotatable disk assembly is comprised of an inner disk and an outer ring disposed around the inner disk, wherein the inner disk is configured to rotate at least clockwise about the upper surface.

4. A cap as defined in claim 3 wherein the outer ring is configured to rotate at least clockwise about the upper surface.

5. A cap as defined in claim 1 wherein the underside surface is comprised of a concavity being sized to receive one of a bottle opening, a raised hub of a cap and a standard cap.

6. A cap as defined in claim 5 wherein the gripping mechanism comprises one of a gripping protrusion and a threaded surface within the concavity to mate with the raised hub.

7. A cap as defined in claim 1 wherein the textured indicia is selected from the group consisting of a raised three dimensional icon, an inscribed icon, and raised characters.

8. A cap as defined in claim 1 wherein the disk assembly includes an outer ring comprised of two half rings of two different colors and different time of day icons or indicia.

9. A cap as defined in claim 1, wherein the body of the cap is configured for a non-cylindrical medicine container.

10. A cap as defined in claim 1 further comprising a container adapted to receive the body, the combination of the cap and container further adapted to be combined with a medicine cradle to form a medication management system.

11. A medicine management system of claim 10 wherein the medicine cradle includes a display configured to provide at least one of time of dosage, medication description, condition being treated and identity of a user.

12. A cap assembly for a medicine container configured as a medication intake reminder, the cap assembly comprising:

a top plate having an upper surface and an underside surface, the upper surface having a first textured indicia representing a medical condition to be treated and a second textured indicia representing a time of day a medication is to be taken by a patient; and a base plate having a gripping mechanism disposed on a base underside surface of the base plate, the base plate configured to have at least one attachment mechanism on a top surface of the base plate to receive and attach the top plate, wherein the gripping mechanism is configured to attach the base plate to one of a medicine container and a standard prescription bottle cap, wherein at least one of the textured indicia is raised from the upper surface of the top plate and is adapted to be removably attached to the top plate.

13. A cap as defined in claim 12 wherein at least one of the textured indicia is configured to be inscribed on the upper surface of the top plate.

14. A cap as defined in claim 12 wherein the top plate is configured to be rotatable about the top surface of the base plate, the top plate including a textured indicia representing a duration or time period for taking a medicine dosage.

15. A cap for a medicine container configured as a medication intake reminder, the cap comprising:

a textured indicia assembly having an upper body and a fastening mechanism attached underneath, the upper body having a first textured indicia representing a medical condition to be treated and; and an elongate slot on a surface of the cap configured to receive the fastening mechanism, thereby attaching the textured indicia assembly to the medicine container cap surface.

16. A cap as defined in claim 15 wherein the indicia assembly has a second textured indicia representing a time of day a medication is to be taken by a patient.

* * * * *